US008535017B2

(12) United States Patent
McNichol et al.

(10) Patent No.: US 8,535,017 B2
(45) **Date of Patent: *Sep. 17, 2013**

(54) HYDRAULIC GRAVITY RAMP PUMP

(75) Inventors: Richard F. McNichol, Surrey (CA); Gordon Bryce, White Rock (CA)

(73) Assignee: Richard Frederick McNichol, Surrey, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/169,243

(22) Filed: Jun. 27, 2011

(65) Prior Publication Data

US 2011/0255997 A1 Oct. 20, 2011

Related U.S. Application Data

(63) Continuation of application No. 10/587,903, filed as application No. PCT/CA2005/000096 on Jan. 27, 2005, now Pat. No. 7,967,578, which is a continuation-in-part of application No. 10/765,979, filed on Jan. 29, 2004, now abandoned.

(51) Int. Cl.
*F04B 43/12* (2006.01)
*F04B 49/06* (2006.01)

(52) U.S. Cl.
USPC ..... 417/53

(58) Field of Classification Search
USPC ..... 417/225, 226, 383, 393, 401, 390, 417/547, 554, 555.1, 53; 92/110
See application file for complete search history.

(56) References Cited

U.S. PATENT DOCUMENTS

| | | | |
|---|---|---|---|
| 1,532,231 | A | 4/1925 | Corey |
| 1,907,948 | A | 5/1933 | Gage |
| 1,981,288 | A | 11/1934 | Ross |
| 2,014,613 | A | 9/1935 | Ceverha |
| 2,174,114 | A | 9/1939 | Will |

(Continued)

FOREIGN PATENT DOCUMENTS

| | | | |
|---|---|---|---|
| AU | 2005207990 | B2 | 8/2005 |
| AU | 2011201523 | A1 | 4/2011 |

(Continued)

OTHER PUBLICATIONS

Office Action issued Apr. 5, 2012 in U.S. Appl. No. 12/023,016.

(Continued)

*Primary Examiner* — Devon Kramer
*Assistant Examiner* — Amene Bayou
(74) *Attorney, Agent, or Firm* — Knobbe Martens Olson & Bear, LLP

(57) ABSTRACT

A piston type pumping apparatus comprises a vertically oriented cylinder having a top and a bottom with a first aperture. There are first and second passageways for liquid in the cylinder at the top and bottom respectively thereof. A piston is reciprocatingly mounted within the cylinder and has an area against which pressurized fluid acts in the direction of movement of the piston. A hollow piston rod is connected to the piston and extends below the piston and slidably through the first aperture. There is a reload chamber below the cylinder. The piston rod extends slidably into the reload chamber and has a third passageway for liquid communicating thereto. A first one-way valve is located in the third passageway. There is also a fourth passageway that extends from the reload chamber to a source of liquid to be pumped and a second one-way valve therein.

3 Claims, 7 Drawing Sheets

(56) References Cited

U.S. PATENT DOCUMENTS

| | | | | | |
|---|---|---|---|---|---|
| 2,342,855 | A | | 2/1944 | Green | |
| 2,376,538 | A | | 5/1945 | Hardey | |
| 2,490,118 | A | | 12/1949 | Dickinson | |
| 2,817,298 | A | | 12/1957 | Bloudoff | |
| 2,942,552 | A | * | 6/1960 | Wayt | 417/401 |
| 2,949,854 | A | * | 8/1960 | Stewart | 102/531 |
| 2,949,857 | A | | 8/1960 | Coberly | |
| 3,135,210 | A | | 6/1964 | English | |
| 3,148,629 | A | * | 9/1964 | Sutliff | 417/434 |
| 4,026,661 | A | | 5/1977 | Roeder | |
| 4,219,311 | A | * | 8/1980 | Simon | 417/260 |
| 4,421,463 | A | | 12/1983 | Lee | |
| 4,473,340 | A | | 9/1984 | Walsworth | |
| 4,551,075 | A | * | 11/1985 | Canalizo | 417/383 |
| 5,118,517 | A | | 6/1992 | Palermiti | |
| 5,188,517 | A | * | 2/1993 | Koster | 417/393 |
| 5,337,565 | A | * | 8/1994 | Meixner | 60/594 |
| 1,616,744 | A | | 8/1997 | Warren | |
| 5,785,500 | A | * | 7/1998 | Leniek | 417/46 |
| 5,984,642 | A | * | 11/1999 | Danielsson | 417/264 |
| 6,193,476 | B1 | * | 2/2001 | Sweeney | 417/401 |
| 7,967,578 | B2 | * | 6/2011 | McNichol et al. | 417/401 |
| 2005/0169776 | A1 | | 8/2005 | McNichol | |
| 2005/0249613 | A1 | | 11/2005 | Jordan et al. | |
| 2006/0000616 | A1 | | 1/2006 | Crawford | |
| 2008/0219869 | A1 | | 9/2008 | Fisher et al. | |

FOREIGN PATENT DOCUMENTS

| | | | |
|---|---|---|---|
| CA | 1041371 | | 10/1978 |
| CA | 1057121 | | 6/1979 |
| CA | 1198315 | | 12/1985 |
| CA | 2299486 | | 6/2004 |
| CA | 2554856 | | 12/2009 |
| EP | 17140310 | | 12/2009 |
| FR | 2 545 886 | | 11/1984 |
| GB | 631 521 | | 11/1949 |
| HK | 1098186 | | 5/2010 |
| MX | PA06008420 | A | 10/2010 |
| RU | 2362050 | | 7/2009 |
| WO | WO 84/01002 | A1 | 3/1984 |
| WO | WO 2005/073555 | A1 | 8/2005 |

OTHER PUBLICATIONS

PCT International Search Report and the Written Opinion in PCT/CA2008/000206 issued Apr. 30, 2008.

PCT International Preliminary Report on Patentability in PCT/CA2008/000206 issued Aug. 4, 2009.

PCT Written Opinion issued May 19, 2005 in PCT/CA2005/000096.

PCT International Search Report issued Mar. 16, 2005 in PCT/CA2005/000096.

PCT IPRP issued Nov. 28, 2005 in PCT/CA2005/000096.

Supplementary European Search Report for EP 05 70 6422, dated Mar. 7, 2007.

Notice of Intention to Grant dated Jun. 24, 2009 in European patent application No. 05706422.2.

Applicant's Response to Official Action dated Nov. 29, 2007 in European patent applicant's No. 05706422.2.

Official Action dated May 21, 2007 in European patent application No. 05706422.2.

Notice of Allowance dated Jul. 9, 2009 in Canadian patent application No. 2554856.

Applicant's Response to Official Action dated Feb. 6, 2009 in Canadian patent application No. 2554856.

Official Action dated Aug. 6, 2008 in Canadian patent application No. 2554856.

Notice of Acceptance dated Jan. 15, 2009 and English translation in Russian patent application No. 2006130682.

Notice of Allowance dated Aug. 31, 2010 in Mexican patent application No. PA/a/2006/008420.

Applicant's Response to Official Action dated Aug. 13, 2010 in Mexican patent application No. PA/a/2006/008420.

Official Action dated Mar. 30, 2010 in Mexican patent application No. PA/a/2006/008420.

Applicant's Response to Official Action dated Dec. 17, 2009 in Mexican patent application No. PA/a/2006/008420.

Official Action dated Oct. 8, 2009 in Mexican patent application No. PA/a/2006/008420.

Applicant's Response to Official Action dated Sep. 9, 2009 in Mexican patent application No. PA/a/2006/008420.

Official Action dated Jul. 16, 2009 in Mexican patent application No. PA/a/2006/008420.

Applicant's Response to Official Action dated Apr. 1, 2009 in Mexican patent application No. PA/a/2006/008420.

Official Action dated Jan. 29, 2009 in Mexican patent application No. PA/a/2006/008420.

Office Action dated Oct. 2, 2009 in Australian patent application No. 2005207990.

Office Action dated Oct. 5, 2010 and English translation in Japanese patent application No. 2006-549817.

* cited by examiner

HYDRAULIC GRAVITY RAMP PUMP

CROSS-REFERENCE TO RELATED APPLICATIONS

This is a continuation of U.S. patent application Ser. No. 10/587,903, which is National Stage Application of PCT/CA05/00096, filed on Jan. 27, 2005, which is a continuation-in-part of U.S. patent application Ser. No. 10/765,979, filed on Jan. 29, 2004. Each of the above-referenced applications is hereby incorporated by reference in its entirety.

BACKGROUND OF THE INVENTION

This invention relates to pumps, and in particular to piston type pumps for pumping liquids to significantly higher elevations and pumps having energy recovery means.

Pumping liquids against substantial hydraulic heads is a problem encountered in pumping out mines, deep wells, and similar applications such as pumping water back up, over a hydro dam during low energy usage periods, for subsequent recovery during high energy usage periods, and for use in run-of-the-river hydro power applications utilizing the potential energy of water in a standing column.

A number of earlier patents attempt to provide devices which utilize a piston type pump where energy is recovered from a column of liquid acting downwardly on the piston, as the piston moves downwardly, in order to assist in subsequently raising the piston together with a volume of liquid to be pumped upwardly. An example of such an earlier patent is U.S. Pat. No. 6,193,476 to Sweeney. However such earlier devices have not been efficient enough to justify their commercial usage. For example, in the Sweeney patent, the efficiency of the apparatus is significantly reduced due to the fact that the upper piston 38 has the same cross-sectional area as lower piston 43. Thus the pressure of liquid acting upwardly on the lower piston 43 inhibits downward movement of the upper piston 38 under the weight of the liquid in the cylinder above.

It is an object to the invention to provide an improved pumping apparatus capable of pumping liquids against significant hydraulic heads, such as encountered in deep wells or in pumping out mines, without requiring pumps with high output heads.

It is a further object of the invention to provide an improved piston type pumping apparatus with provision for energy recovery, having significantly improved efficiency compared with prior art devices of the general type as well as the ability to use the potential energy of a standing column.

It is still further object of the invention to provide an improved piston type pumping apparatus which is simple and rugged in construction, and efficient to operate and install.

SUMMARY OF THE INVENTION

According to the invention there is provided a piston type pumping apparatus, comprising a vertically oriented cylinder having a top and a bottom with a first passageway for liquid in the cylinder adjacent to the top thereof. There is a second passageway for liquid in the cylinder adjacent to the bottom thereof. A piston is reciprocatingly mounted within the cylinder. The piston has an area against which pressure acts in the direction of movement of the piston. A hollow piston rod is connected to the piston and extends slidably and sealingly through an aperture in the bottom of the cylinder. There is a reload chamber below the cylinder, the piston rod extending slidably and sealingly into the reload chamber and having a third passageway for liquid communicating with the reload chamber. The piston rod has a smaller area within the reload chamber upon which pressurized fluid in the reload chamber acts in a direction of movement of the piston and piston rod, compared to the area of the piston, whereby liquid in the cylinder acting downwardly on the piston exerts a greater force on the piston than liquid in the reload chamber acting against the piston rod. There is a first one-way valve located in the third passageway which permits liquid to flow from the reload chamber into the piston rod and prevents liquid from flowing from the piston rod into the reload chamber. A fourth passageway for liquid extends from the reload chamber to a source of liquid to be pumped. A second one-way valve in the fourth passageway permits liquid to flow from the source of liquid into the reload chamber and prevents liquid from flowing from the reload chamber towards the source of liquid. There is means for storing pressurized liquid connected to the second passageway for storing pressurized liquid displaced from below the piston, as the piston moves downwardly, and to assist in raising the piston and, accordingly, liquid contained within the piston rod, to pump liquid upwardly and through the first passageway.

For example, the means for storing may include a pressurized body of liquid.

There may be a pump connected to the body of liquid for pumping liquid into the cylinder below the piston to raise the piston.

In one example the pump is a piston pump. The body of liquid may be a vertical column of liquid.

In another example, the pump may be a rotary pump and the means for storing may include a receiver for pressurized liquid connected to the pump.

The invention offers significant advantages compared with conventional pumps for deep wells, pumping out mines and other applications for pumping liquids up relatively high hydraulic heads, such as energy recovery at hydro dams. It allows the use of a pump which requires far less energy input to pump liquids up significant vertical distances because it converts the potential energy of the standing column into kinetic energy. At the same time, it overcomes disadvantages associated with prior art pumps of the general type by increasing its efficiency significantly by comparison. Thus the invention is attractive for commercial applications where prior art devices have not proven to be viable.

DETAILED DESCRIPTION OF THE PREFERRED EMBODIMENTS

Figure 1:
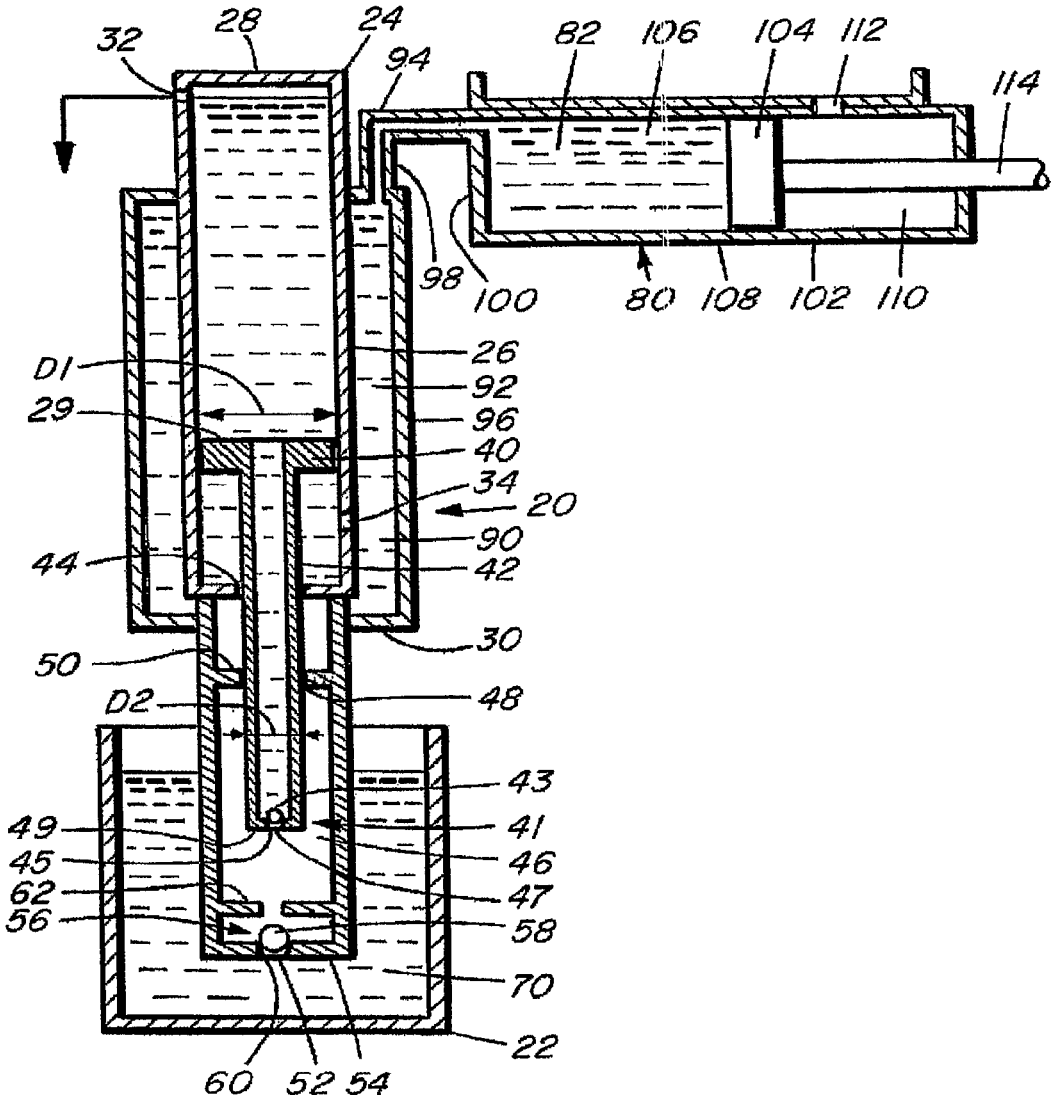
FIG. 1 is a simplified elevational view, partly in section, of a pumping apparatus according to an embodiment of the invention.

Referring to the drawings, and first to FIG. 1, this shows a piston type pumping apparatus 20 according to an embodiment of the invention. The apparatus is intended to pump liquids, typically water, up relatively great vertical distances, such as from the bottom 30 of a mine to the surface as exemplified by the distance between points 22 and 24. The system includes a vertically oriented first transfer cylinder 26 having a top 28, adjacent point 24, and a bottom 30. There is a first passageway 32 for liquid adjacent the top where liquid is discharged from the cylinder. There is a second passageway 34 near the bottom of the cylinder which allows liquid to enter or exit the cylinder.

A transfer piston 40 is reciprocatingly mounted within the cylinder and is connected to a vertically oriented, hollow piston rod 42 which extends slidably and sealingly through aperture 44 in the bottom of the cylinder. The piston 40 has an area 29 at the top thereof against which pressurized fluid in the cylinder acts. The passageway 32 is above or adjacent to the uppermost position of the piston and the passageway 34 is below its lowermost position. It should be understood that FIG. 1 is a simplified drawing of the invention and seals and other conventional elements which would be apparent to someone skilled in the art are omitted. These components would be similar to those disclosed in U.S. Pat. No. 6,913,476, which is incorporated herein by reference in its entirety.

There is a first one-way valve 41 at the bottom of the piston rod 42 which includes a valve member 43 and a valve seat 45 which extends about a third passageway 47 in bottom 49 of the piston rod. This one-way valve allows liquid to flow into the piston rod, but prevents a reverse flow out the bottom of the piston rod.

There is a reload chamber 46 below the cylinder 26 which is sealed, apart from aperture 48 at top 50 thereof, which slidably and sealingly receives piston rod 42, and fourth passageway 52 at bottom 54 thereof. The piston rod acts as a piston within the reload chamber. There could be a piston member on the end of the rod within the reload chamber and the term "piston rod" includes this possibility. A second one-way valve 56 is located at the passageway 52 and includes a valve member in the form of ball 58 and a valve seat 60 adjacent to the bottom of the reload chamber. There is an annular stop 62 which limits upward movement of the ball. This one-way valve allows liquid to flow from a source chamber 70 into the reload chamber 46, but prevents liquid from flowing from the reload chamber towards the chamber 70. Chamber 70 contains liquid to be pumped out of passageway 32 at top of the cylinder.

The piston 40 has a diameter D1 which is substantially greater than diameter D2 of the piston rod and, accordingly, the piston rod, acting as a piston in the reload chamber, has a significantly smaller area upon which pressurized liquid acts, in the direction of movement of the piston rod and piston 40, within the reload chamber 46 compared to the cross-sectional area of the piston 40 and the interior of cylinder 26. For example, in one embodiment the piston is 3" in diameter, while the piston rod 42 is 1" in diameter. Therefore liquid in the cylinder at a given pressure exerts a much greater force on the piston and piston rod compared to the force exerted upwardly on the piston rod and piston by a similar pressure of liquid in reload chamber 70.

There is means 80 for storing pressurized liquid 82 connected to the second passageway 34. This means 80 stores pressurized liquid recovered from chamber 90 in the cylinder 26 below the piston 40. In this particular embodiment the means includes a column of liquid 92 extending from passageway 34 to a point 94 at the top of the column. The column in this example is formed by an annular jacket 96 extending about the cylinder 26 and a conduit 98 extending to discharge end 100 of a second, power cylinder 102. The column can be pressurized by a remotely located power cylinder or by using a body of liquid (water), located at a higher elevation, as a pressure head.

The cylinder 102 has a piston 104 reciprocatingly mounted therein. The liquid 82 occupies chamber 106 on side 108 of the piston which faces discharge end 100 of the cylinder. Chamber 110 on the opposite side of the piston is vented to atmosphere through passageway 112. There is a piston rod 114 connected to the piston 104 to drive the piston towards the discharge end and thereby discharge liquid 82 from the cylinder.

In operation, the cylinder 26 is filled with liquid, typically water, above the piston 40. Likewise chamber 90 is filled with water along with the jacket 96 and chamber 106 of the second cylinder 102. Similarly piston rod 42 is filled with water or other liquid along with the reload chamber 46 and the source chamber 70. The piston is in the lowermost position as shown in FIG. 1. This is required to prime the pump.

The piston rod 114 is then moved to the left, from the point of view of FIG. 1, typically by a motor or engine with a crank mechanism or a pneumatic or hydraulic device, although this could be done in other ways. This displaces liquid 82 from the cylinder 102 downwardly through the column 92, through the second passageway 34 into the chamber 90 where it acts upwardly against the bottom of piston 40 and pushes the piston upwards in the cylinder 26.

The piston rod 42 is pushed upwardly along with the piston and thereby reduces pressure in reload chamber 46, since the volume occupied by the piston rod in the reload chamber is reduced as the piston rod moves upwardly. One-way valve 41 prevents liquid from flowing from the piston rod into the reload chamber, but the reduced pressure within the reload chamber causes ball 58 to rise off of its seat 60, such that liquid flows from chamber 70 into the reload chamber.

When piston 104 of the cylinder 102 approaches the end of its travel adjacent discharge end 100, and piston 40 approaches its uppermost position towards top 28 of the cylinder 26, liquid is discharged from the passageway 32. When the piston 104 has reached its limit adjacent discharge end 100, pressure against piston rod 114 is released. The weight of liquid occupying cylinder 26 above the piston 40 acts downwardly on the piston and forces the piston towards its lowermost position shown in FIG. 1. This forces liquid out of chamber 90 and into the chamber 106 of cylinder 102, moving the piston 104 to the right, from the point of view of FIG. 1, so it returns to the original position shown.

At the same time, the piston rod 42 is forced downwardly into the reload chamber 46. This increases pressure in the reload chamber and keeps the ball 58 against valve seat 60 to prevent liquid from flowing back into the source chamber 70 through the passageway 52. The liquid in the reload chamber is thus forced upwardly into the piston rod 42 by raising valve member 43 off of valve seat 45. In this way, a portion of the liquid in reload chamber 46, which had flowed into the reload chamber from the source chamber as the piston was previously raised, moves from the reload chamber into the piston rod and refills the cylinder 26 above the piston 40 as the piston moves downwardly towards its lowermost position shown in FIG. 1.

The piston 104 in the cylinder 102 is then pushed again to the left, from the point of view of FIG. 1, and again raises the piston 40. A volume of liquid equal to the volume of liquid which moved into the piston rod 42 from the reload chamber 46, as the piston 40 previously moved downwards, is then discharged from passageway 32 as the piston 40 approaches its uppermost position and piston 102 approaches its position closest to the discharge end 100 of cylinder 102.

The cycles are then continued and, as may be readily understood, each time the piston 40 moves down and back up, it pumps a volume of liquid from the reload chamber 46, and ultimately from source chamber 70, equal to the difference in volume occupied by the piston rod 44 within the reload chamber 46, when the piston 40 is in the lowermost position as shown in FIG. 1, less the volume it occupies within the reload chamber (if any) when the piston 40 has reached its uppermost position. The travel of the piston 40 is adjusted so that the piston rod remains within the aperture 48 at the uppermost limit of travel of the piston 40 and piston rod.

The pump apparatus described above is capable of pumping liquid from point 22 to point 32 as described above. Thus the apparatus is capable of pumping liquid against a significant hydraulic head, such as experienced in pumping water from the bottom of a mine, without requiring a pump with a high hydraulic head output. This is because liquid in column 92 acts upwardly against the bottom of the piston 40 and assists the movement of the piston 104 towards the left, from the point of view of FIG. 1. When the piston 40 is moved downwardly by the weight of liquid in cylinder 26 above the piston, it moves the liquid in chamber 90 upwardly, increasing its hydraulic head and building up its potential energy. Thus a large portion of the energy lost as the piston 40 moved downwardly is recovered in potential energy represented by the liquid in column 92 extending to cylinder 102.

Thus it may be seen that the cylinder 102 should be placed as high as possible for the maximum recovery of the energy. It should be understood that the position of cylinder 102 could be different than shown in FIG. 1. It could be, for example, oriented vertically. The terms "left" and "right" used above in relation to the cylinder, piston and piston rod are to assist in understanding the invention and are not intended to cover all possible orientations of the invention.

Figure 2:
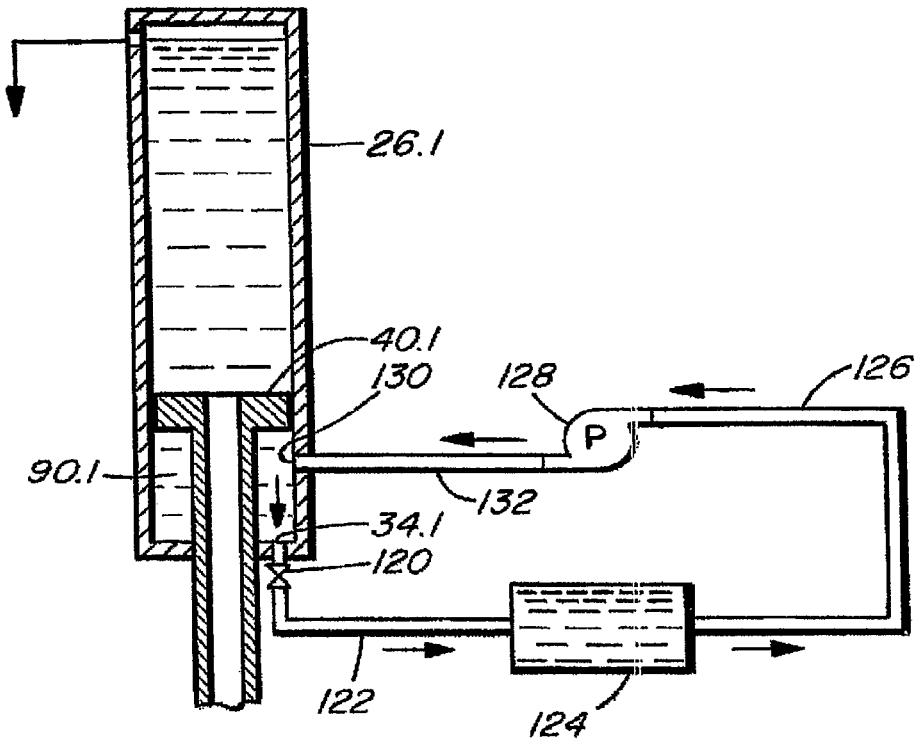
FIG. 2 is a simplified elevational view, partly in section, of the upper fragment of an alternative embodiment employing a centrifugal pump.

FIG. 2 shows a pumping apparatus 20.1 which is generally similar to the apparatus shown in FIG. 1 with like parts having like numbers with the addition of "0.1". It is herein described only with respect to the differences between the two embodiments. Only the upper portion of the apparatus is shown, the reload chamber and source chamber being omitted because they are identical to the first embodiment. In this example passageway 34.1 is fitted with a one-way valve 120 which permits liquid to flow from chamber 90.1 into conduit 122, but prevents liquid from flowing in the opposite direction. The conduit 122 is connected to a receiver 124 which may be similar in structure to a hydraulic accumulator, for example, and is capable of storing pressurized hydraulic fluid. When the piston 40.1 is moved downwardly by the liquid in cylinder 26.1, it is forced into the receiver 124.

There is a hydraulic conduit 126 which connects the receiver to a centrifugal pump 128 which is connected to passageway 130 in the cylinder 26.1 below the piston 40.1 via a conduit 132. After the piston reaches its bottommost position, as shown in FIG. 2, pump 128 is started to pump liquid from the receiver 124 into the chamber 90.1 to lift the piston 40.1. The fact that the liquid in the receiver 124 was pressurized during the previous downward movement of piston 40.1 reduces the work required from pump 128 to assist in raising the piston. Thus this apparatus operates in a manner analogous to the embodiment of FIG. 1, but uses the receiver to store pressurized hydraulic fluid instead of utilizing a physical, vertical hydraulic head as in the previous embodiment. Furthermore a centrifugal pump 128 is employed instead of the piston pump comprising cylinder 102 and piston 104 of the previous embodiment. Otherwise this apparatus operates in a similar manner.

Analysis of Pressures and Force Balance

Referring to FIGS. 1 through 5:

$A_1$ is the area of the top 29 of the transfer piston 40 which is the area of the transfer cylinder 26

$A_2$ is the area of the bottom of the piston rod 42

$A_1$-$A_2$ is the area of the transfer piston in contact with the power fluid

S is the stroke length $P_1$ is the pressure of the standing column $P_2$ is the pressure of the working fluid during the power stroke $P_3$ is the available head of the fluid to be pumped $P_4$ is the pressure in the transfer chamber $P_5$ is the pressure of the power fluid during the recovery stroke $P_c$ is the pressure created in the power cylinder 102 located at the same level as the standing column discharge 32

W is the weight of the piston

R is the resistance created by the seals d is the density of water (0.036 lbs/in$^3$)

$A_c$ is the area of the Power Cylinder $S_c$ is the stroke of the Power Cylinder H is the height of the standing column of water d is the density of water During the recovery stroke the transfer piston moves down, with valve member 43 open and valve 56 closed.

$$\text{Downward Forces } F_d=P_1A_1+W$$

$$\text{Upward Forces } F_u=P_2(A_1-A_2)+P_4A_2+R$$

$$\text{Net force } F=F_d-F_uP_1A_1+W-P_2(A_1-A_2)-P_4A_2-R$$

If we assume:

$P_1$=45 psig, approximately 100 feet of water, and $A_1$=8 in$^2$, $P_1A_1$=45×8=360 lbs a piston weight of 2 lbs (approximately 8 in$^3$ of steel)

a seal resistance 20 lbs $P_4$=$P_1$ and therefore $P_4A_2$=$P_1A_2$ $$F=P_1A_1-P_1A_2-P_5(A_1-A_2)-R$$

$$F=P_1(A_1-A_2)-P_5(A_1-A_2)-R=(P_1-P.su-b.5)(A_1-A_2)-R$$

For this to be a net downward force, $P_5$ must be less than $P_1$. The area that $P_1$ operates on is ($A_1$-$A_2$).

During the power stroke the transfer piston moves up and valve member 43 closed.

$$\text{Downward forces } F_d=P_1A_1+W+R$$

$$\text{Upward forces } F_u=P_2(A_1-A_2)+P_4A_2$$

$$\text{Net force}=F=F_u-F_d=P_2(A_1-A_2)+P_4A_2--P_1A_1-W-R$$

$P_4$=$P_3$. If we assume $P_3$<<P or $P_2$, we can ignore $P_4A_2$.

As for the recovery stroke we can ignore W.

$$F=P_2(A_1-A_2)-P_1A_1-R$$

Efficiency

Work in During the Recovery Stroke $P_5$=$P_1$−$P_c$ where $P_c$ is the pressure created in the power cylinder located at the same level as the standing column discharge.

Work Done at the Power Cylinder $$W_i=P_cA_cS_c$$

$A_cS_c$ is the volume of power fluid moved per stroke=$(A_1-A_2)S$ $W_i=P_c(A_1-A_2)S$, For an example, $P_c$=14 psig, $A_1$=8 $in^2$ $_1A_2$=4 $in^2$ $_1$ and S=12 in $W_1$=14(8−4)12=672 in lbs (56 ft lbs) plus R×S 20×12=240 in lbs. $A_2/A_1$=0.5

Work in During the Power Stroke $P_2=P_1+P_c$. In order to create an acceleration of "a" times g (32.2 ft/sec$^2$) in the standing column, the net force must be "a" times the weight of the standing column.

$$F=P_2(A_1-A_2)-P_1A_1-R=aHA_1d=aP_1A_1$$

$$(P_1+P_c)(A_1-A_2)-P_1A_1-R=aP_1A_1$$

$$P_1A_1-P_1A_2+P_cA_1-P_1A_2-P.su-b.1A_1-R=aP_1A_1.$$

The bold terms cancel.

$$P_c(A_1-A_2)=aP_1A_1+P_1A_2+R$$

$$P_c=\frac{P_1(aA_1+A_2)}{(A_1-A_2)}+\frac{R}{(A_1-A_2)}$$

For a head of 100 feet, $P_1$=43.3 psig, and a=1 g, R=20 lbs.

$$P_c=\frac{43.3(1\times 8+4)}{4}+\frac{20}{4}=130+5=135psig$$

Work in at the Power Cylinder $W_i=P_c(A_1-A_2)S$=135×4×12=6480 in lbs

Work Output

The amount of water lifted is $SA_2d$=12×4×0.036=1.73 lbs it is raised 1200 inches $W_0$=1/73×1200=2070 in lbs=173 ft lbs Efficiency based on $A_2/A_1$ ratio of 0.5

$E=W_0/W_1$=2070/(6480+672+240)=28.0%

By examining the above formula for $P_c$ one can see how changing the acceleration and the ratio of $A_2/A_1$ affects the pressure necessary to drive the pump. For example:

$A_2/A_1$=0.8 or in the example $A_2$ would now=6.4 sq. in. and a=0.25 g $$P_c=\frac{P_1(aA_1+A_2)}{(A_1-A_2)}+\frac{R}{(A_1-A_2)}$$

$$P_c=\frac{43.3(.25\times 8+6.4)}{1.6}+\frac{20}{1.6}$$

$$=227+12.5$$

$$=249.5psig$$

or using a lower $A_2/A_1$ ratio—say 0.25, now $A_2$=2 and leaving acceleration at 0.25 g $$P_c=\frac{P_1(aA_1+A_2)}{(A_1-A_2)}+\frac{R}{(A_1-A_2)}$$

$$P_c=\frac{43.3(.25\times 8+2)}{6.6}+20$$

$$=28+3.33$$

$$=31.33psig$$

We are now moving a volume of water up 100 feet in our example by adding 31.33 psi (72.37 ft.) of head to the power column.

Dynamic Analysis of the Original Concept

Recovery Stroke

Continuing with the same example the net force on the Standing Column 26 is: $F=P_c(A_1-A_2)-R$=14(8−4)−20=36 lbs The mass of the Standing Column is 1200×8×0.036=346 lbs.

The acceleration is

36/346=0.10 g=3.22 ft/sec$^2$

The time required to complete the stroke $$D=\frac{ar^2}{2}:D=S \text{ in feet}=1 \text{ foot};$$

$$t=(2S/a)^{0.5}=(2/3.22)^{0.5}=0.79 \text{ seconds}$$

Power Stroke

The acceleration was defined as 1 g or 32.2 ft/sec$^2$.

t=(2/32.2)$^{0.5}$=0.25 seconds.

The complete stroke will take 0.79+0.25=1.03 seconds

The above analysis of pressures and force can be manipulated using different ratios of $A_2/A_1$, $P_2/P_1$ and acceleration "a".

Figure 3:
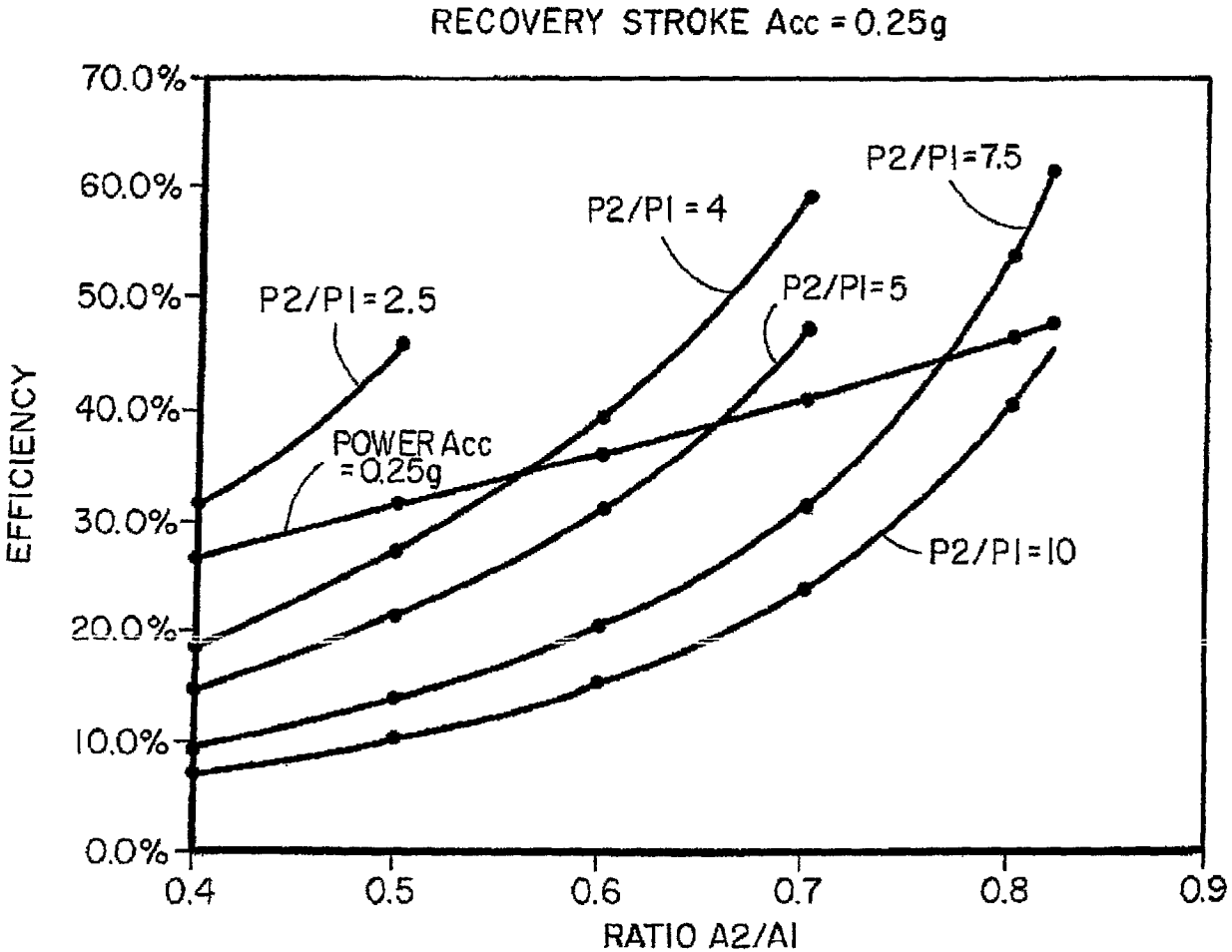
FIG. 3 is a graph of the efficiency of the pressure head concept of the pump.
Figure 4:
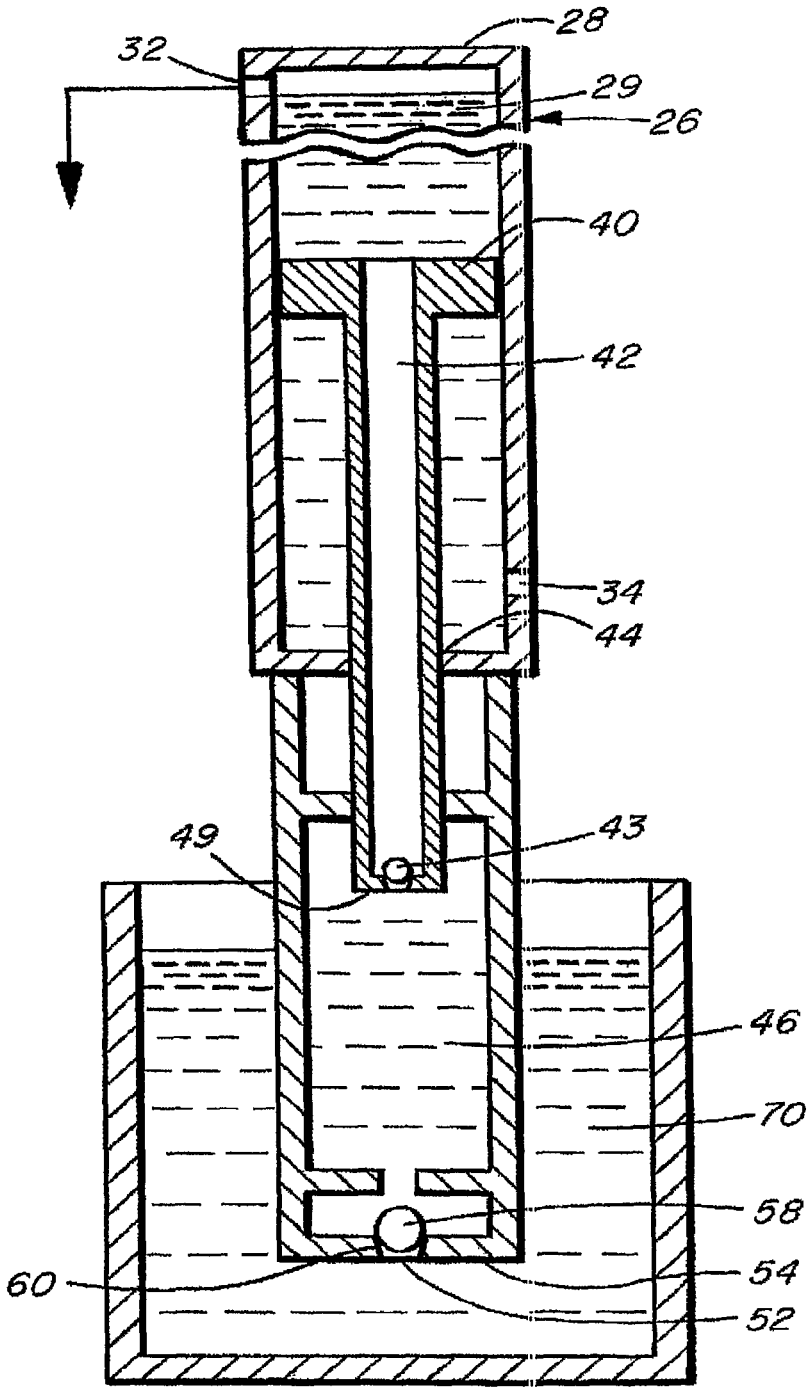
FIG. 4 is a sectional view of the embodiment of FIG. 1 showing the Force Balance in the pump.

Attached as FIG. 3 is a performance curve for the pressure head concept showing the efficiency against the ratio $A_2/A_1$. Also included as Table 1 are the calculations from which FIG. 3 is drawn showing the absolute numeric variations as parameters are changed.

TABLE 1

Efficiency vs. A2/A1

| | A2/A1 = | | | | | |
|---|---|---|---|---|---|---|
| P2/P1 | 0.4 | 0.5 | 0.6 | 0.7 | 0.8 | 0.82 |
| 1.5 | 0.0% | 0.0% | 0.0% | 0.0% | 0.0% | 0.0% |
| 1.8 | 0.0% | 0.0% | 0.0% | 0.0% | 0.0% | 0.0% |
| 2.0 | 41.4% | 0.0% | 0.0% | 0.0% | 0.0% | 0.0% |
| 2.5 | 31.6% | 45.7% | 0.0% | 0.0% | 0.0% | 0.0% |
| 3.0 | 25.5% | 37.2% | 53.3% | 0.0% | 0.0% | 0.0% |
| 4.0 | 18.5% | 27.1% | 39.3% | 59.1% | 0.0% | 0.0% |
| 5.0 | 14.5% | 21.3% | 31.2% | 47.1% | 0.0% | 0.0% |
| 7.5 | 9.4% | 13.9% | 20.5% | 31.3% | 53.7% | 61.1% |
| 10 | 6.9% | 10.3% | 15.3% | 23.5% | 40.2% | 45.8% |
| Optimum | 26.6% | 315.% | 36.0% | 40.7% | 46.3% | 47.5% |
| P5/P1, req | 0.39 | 0.31 | 0.185 | 0.05 | 0.05 | 0.05 |
| Rec Acc ft/sec$^2$ | 8.04 | 8.01 | 8.04 | 7.21 | 4.21 | 3.61 |
| P2/P1 opt | 2.9 | 3.48 | 4.35 | 5.79 | 8.69 | 9.65 |

For the pressure head concept, the curves demonstrate that a pump could approach an efficiency of up to 61% if used in applications where a very high pressure head is available and the power water can be discharged at a very low level, both compared to the height of the standing column. Efficient pump designs have a high $A_2/A_1$ ratio indicating that the volume of water discharged from the standing column is greater than the volume of water used on the power side of the transfer piston. This feature indicates that the pump may be attractive in lifting water from a well or de-watering a mine as long as there is a convenient source of suitable power water; i.e. compatible with the water to be lifted and having a very high head. As previously discussed, a pressure head pump could be attractive in some run-of-the-river hydro applications if a suitable source of power water is convenient.

For the power cylinder concept, the curves indicate that the higher the $A_2/A_1$ ratio the more efficient the pump, and the lower the accelerations the more efficient the pump.

Efficient pressure head concept pumps move a greater volume of process water per stroke than the volume of power water required. This again is a direct result of the high ratios of $A_2/A_1$. This means that the power water could be released to join the process water and still allow effective pumping to occur. Conversely, pumps with low ratios of $A_2/A_1$ but with a large amount of power water and a lower head can move smaller amounts of process water up greater heights. They will expend more power water than the process water they move. This process is similar to the classic hydraulic ram principle where a large amount of fluid at a low pressure head is used to transfer a small amount of fluid up a higher elevation.

A different embodiment of the pump utilizes a bladder similar to a pressure tank in a water system or a packer similar to a drill hole packer that houses the water in the power cylinder that is pressurized by air or hydraulic pressure and then the pressure lowered and again repressurized. This allows the use of the pump without expending the power fluid.

Analysis

Figure 5A:
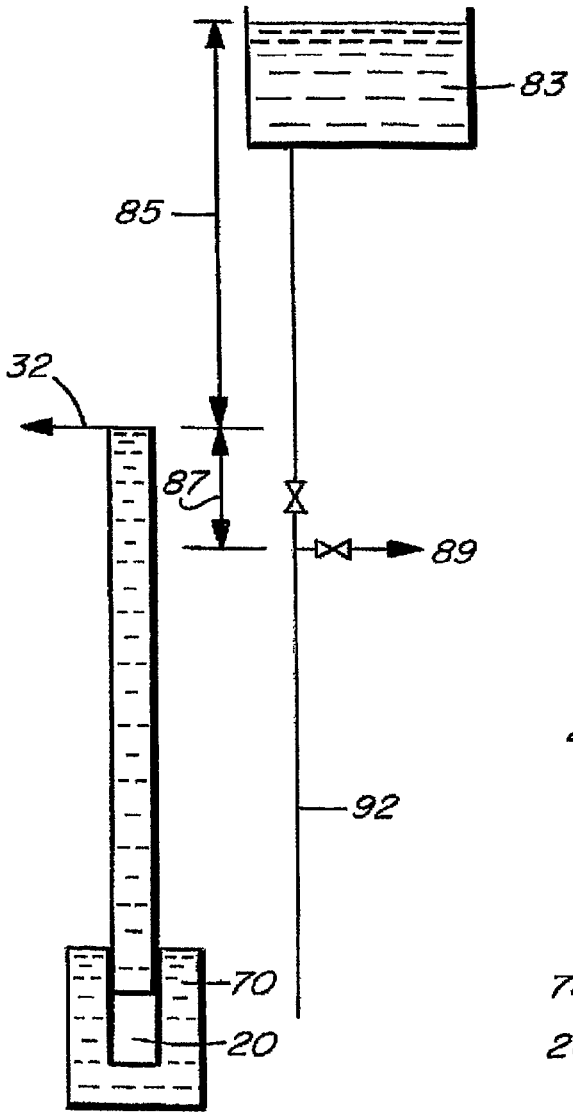
FIGS. 5*a* and 5*b* are simplified sectional views showing Pressure Head Concept of a pump and the Power Cylinder Concept of the pump.
Figure 5B:
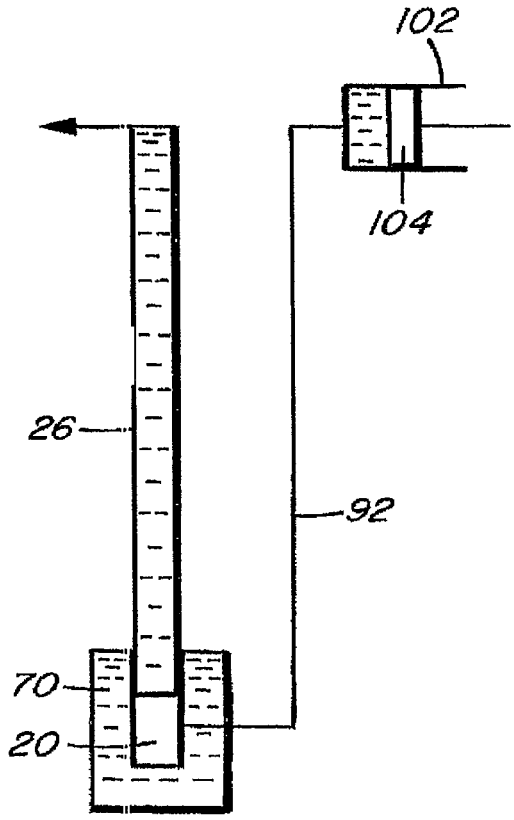

FIG. 5 shows the two main embodiments of the pump. FIG. 5A describes the pressure head concept showing how the liquid, generally water, stored at a higher elevation 83 supplies excess pressure for the power stroke 85 and reduced pressure 87 when point 89 is used for the power fluid release. FIG. 5B shows the power cylinder concept where the excess pressure is generated by the power cylinder 102 and the recovery stroke is augmented by the creation of a vacuum when piston 104 is withdrawn from the column of power fluid.

Performance Curves

Pressure Head Concept

Referring to Table 1, the valves were manipulated to calculate the efficiency of various pressure head arrangements. The manipulation required:

setting various ratios of $A_2/A_1$ from 0.4 to 0.82 then, for each of the ratios, calculating the recovery stroke performance for various ratios of $P_5/P_1$ (the height of the power water release compared to the standing column height), "optimising" $P_5/P_1$ to obtain a recovery stroke acceleration of 8 ft/sec$^2$, if possible, using the "optimised" results from the recovery stroke calculations as input for the power stroke calculations, calculating the power stroke performance for various ratios of $P_2/P_1$ (the height of the power water source compared to the standing column height), "optimising" $P_2/P_1$ was to obtain a power stroke acceleration of 8 ft/sec$^2$, transferring the calculated efficiencies to another spreadsheet along with the "optimised" $P_5/P_1$ and $P_2/P_1$ ratios and the recovery stroke acceleration, using the calculated efficiencies to plot a graph of efficiency vs. $A_2/A_1$ for the most significant ratios of $P_2/P_1$.

The results indicated that high ratios of $A_2/A_1$ result in higher efficiency and low acceleration. The results also indicate that a low ratio of $P_5/P_1$ is required to create reasonable recovery stroke acceleration.

Referring to Table 1, performance data for the ratio $A_2/A_1=0.82$ is shown which indicates that an efficiency of 61% could be achieved if a power stroke acceleration of 8 ft.sec 2 (0.25 g) is considered acceptable. The recovery stroke acceleration will be around 4 ft/sec2 with this design.

What is not immediately apparent is that when the $A_2/A_1$ ratio is high, the amount of power water released per stroke is much less than the amount of process water lifted per stroke. The amount of process water lifted per stroke is $A_2$ S and the amount of power water released per stroke is $(A_2-A_1)S$.

When $A_2/A_1=0.8$:

$(A_2-A_1)=A_1-0.8A_1=0.2A_1$ and the amount of power water released per stroke is $(A_2-A_1)S=0.2\ A_1S$ and $A_2=0.8A_1$:

therefore the amount of process water lifted is $A_2S=0.8\ A_1S$ or four times the amount of power water released.

This means that the power water could be released into the process water and the pump will still pump a net of (0.8−0.2) $A_1S=0.6A_1S$ per stroke.

Power Cylinder Concept

Values were manipulated to calculate the efficiency for various power cylinder arrangements. The manipulation required is:

setting various ratios of $A_2/A_1$; from 0.4 to 0.82, then, for each of the ratios, setting the pressure in the power cylinder ($P_s$) during the recovery stroke, calculating the recovery stroke performance for various ratios of $H_p/H_1$ (the height of the pump compared to the height of the standing column), "optimising" $H_p/H_1$ to obtain a recovery stroke acceleration of 8 ft/sec$^2$, if possible, using the "optimised" results from the recovery stroke calculations as input for the power stroke calculations, calculating the power stroke performance for various ratios of $P_2/P_1$, "optimising" $P_2/P_1$ to obtain a power stroke acceleration of 8 ft/sec$^2$, transferring the calculated efficiencies to another spreadsheet along with the "optimised" $H_p/H_1$ and $P_2/P_1$ ratios and the recovery stroke acceleration, using the calculated efficiencies to plot a graph of efficiency vs. $A_2/A_1$ for the most significant ratios of $P_2/P_1$.

The results indicate that high ratios of $A_2/A_1$ result in higher efficiency and lower ratios allow moving fluid to higher heads but using more process water or a larger power column if contained in a bladder or packer.

Attractive Applications

For the concept pump to be reasonably efficient, the ratio $A_2/A_1$ must be high. For this sort of pump to have a reasonable recovery stroke acceleration the power water in a pressure head style pump must be released very low relative to the height of the standing column. For this sort of pump to have a reasonable power stroke acceleration the power column must be very tall relative to the standing column. These features indicate that the pump would be attractive in applications where there is a source of power water at an elevation much higher than the standing column height. It must also be possible to release the power water at a very low elevation relative to the height of the power column in a pressure head style pump.

Figure 6A:
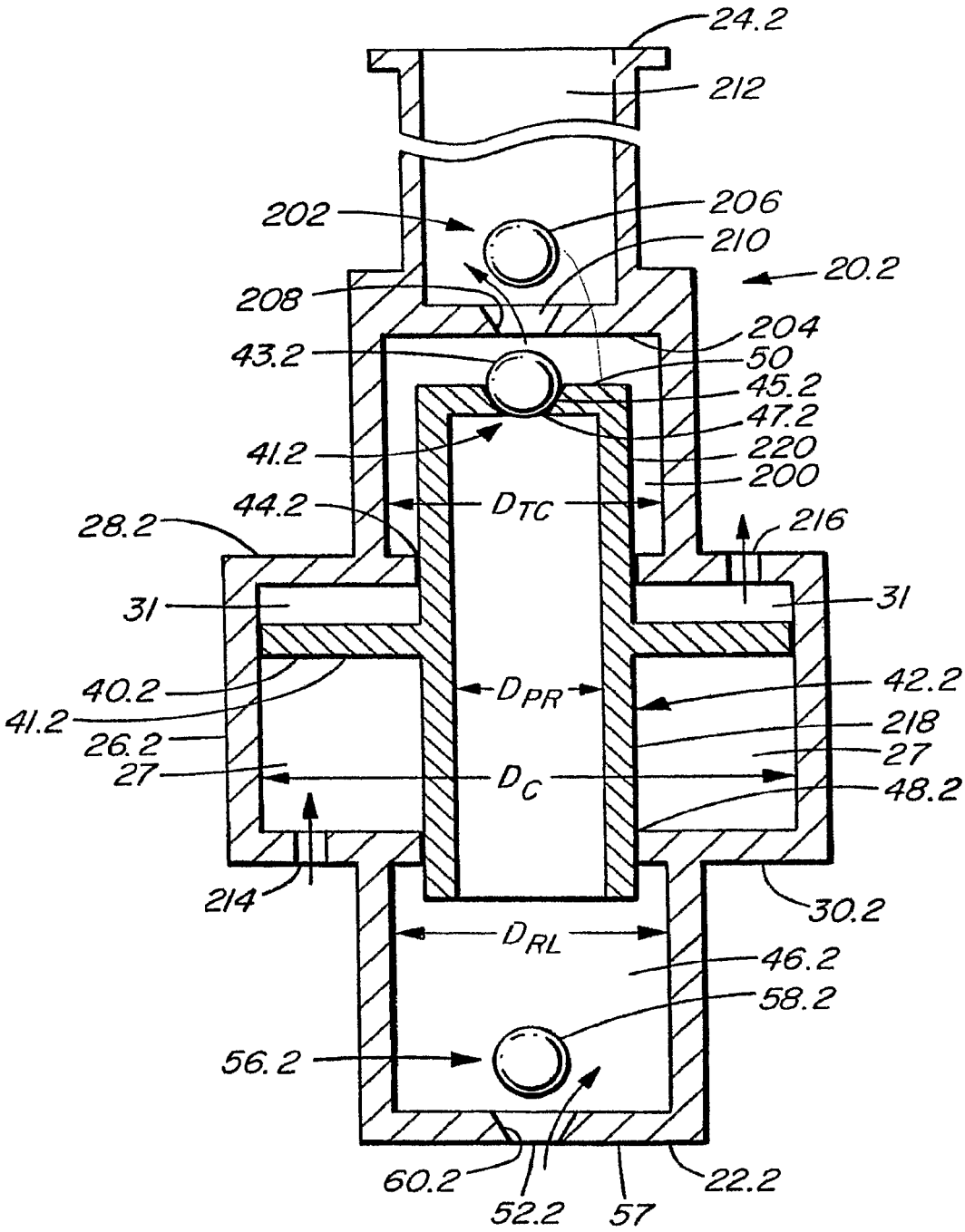
FIGS. 6*a* and 6*b* are simplified elevational views, partly in section, of a pumping apparatus shown in a power stroke and a recovery stroke respectively according to another embodiment of the invention.
Figure 6B:
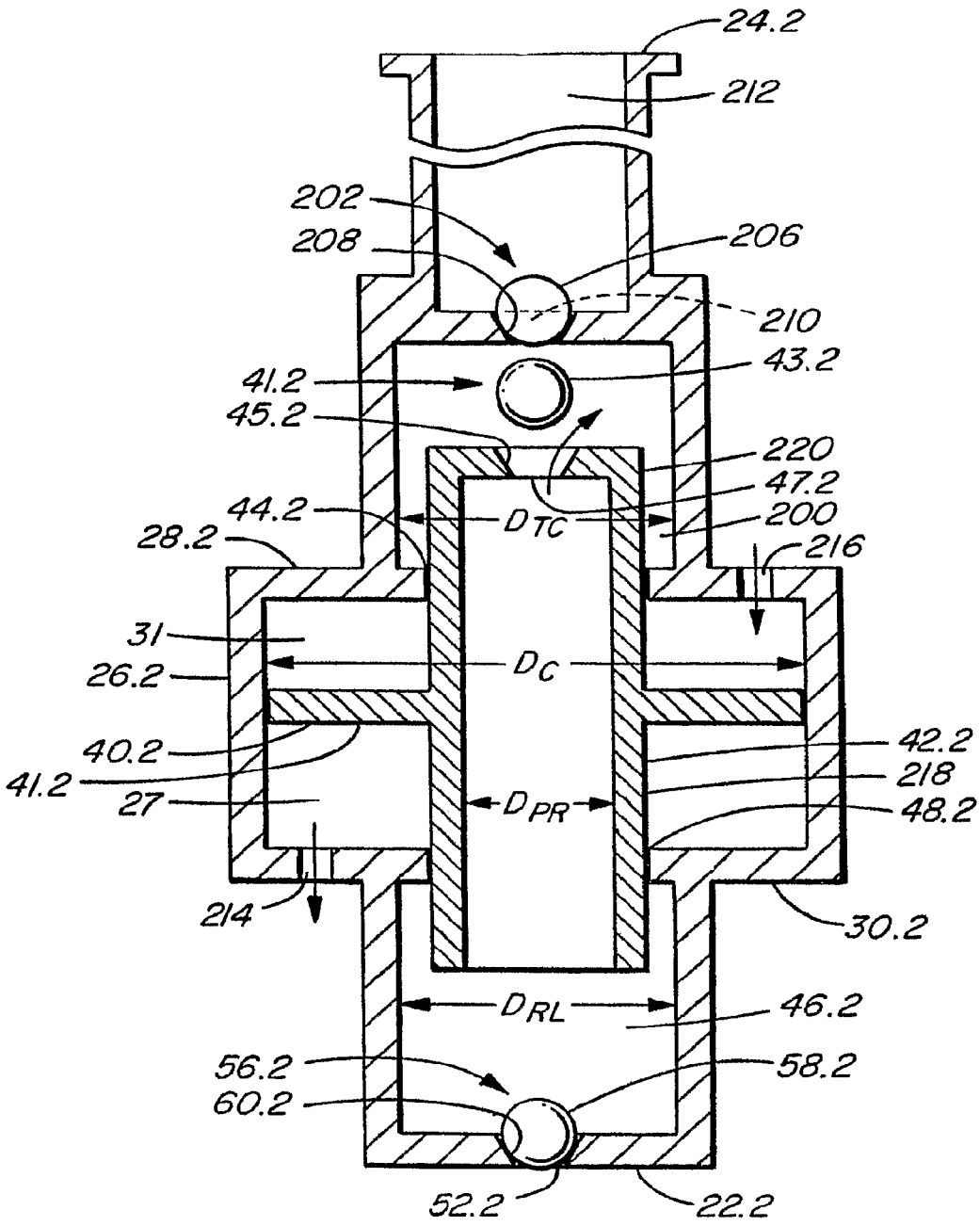

The previously discussed run-of-the-river hydro booster application could fit these requirements, Analysis shows that this application allows the recovery of more than 55% of the energy of a high elevation tributary if it is channeled to a pressure head style pump placed at the bottom. The pump lifts almost five times as much water as is used to power the pump if the water is lifted $1/10^{th}$ of the height of the power head. The water is then recycled through the turbine at the bottom. Using the pump to de-water a mine could also be attractive. Raising water from a well could be attractive. Raising water to a reservoir or to a higher elevation (pressure) could also be attractive Another embodiment of the present invention is illustrated in FIGS. 6*a* and 6*b*, wherein like parts have like reference numerals with the additional suffix "0.2". Referring first to FIG. 6*a*, a piston type pumping apparatus is shown indicated generally by reference numeral 20.2. The apparatus is intended to pump liquids, typically water, up relatively great vertical distances as exemplified by the distance between points 22.2 and 24.2.

There is a vertically oriented cylinder 26.2 having a top 28.2 and a bottom 30.2. A piston 40.2 is reciprocatingly mounted within the cylinder 26.2 and is connected to a vertically oriented, hollow piston rod 42.2 which extends slidably and sealingly through aperture 44.2 in the top 28.2 of the cylinder and aperture 48.2 in the bottom 30.2 of the cylinder. The piston 40.2 is annular in shape, in this example, has a surface area 41.2 and divides the cylinder into two sections exemplified by cylinder space 27 below the piston and cylinder space 31 above the piston. The cylinder 26.2 has a diameter $D_C$ and the hollow piston rod 42.2 has a diameter $D_{PR}$.

The piston rod 42.2 has a first portion 218 below the piston 40.2 and a second portion 220 above the piston. The first portion 218 extends slidably and sealingly through the aperture 48.2 and the second portion 220 extends slidably and sealingly through the aperture 44.2. It should be understood that FIGS. 6*a* and 6*b* are simplified drawings of the invention and seals and other conventional elements which would be apparent to someone skilled in the art are omitted.

There is a first one-way valve, indicated generally by reference numeral 41.2, at top 50 of the piston rod 42.2. Valve 41.2 has a valve member 43.2 and a valve seat 45.2 which extends about a first passageway 47.2 in the top 50 of the piston rod 42.2.

There is a reload chamber 46.2 adjacent bottom 30.2 of the cylinder 26.2 and is sealed with the cylinder apart from the aperture 48.2. The reload chamber 46.2 is in the form of a cylinder, in this example, and has a diameter $D_{RL}$. A second one-way valve indicated generally by reference numeral 56.2 is located at a bottom 57 of the reload chamber 46.2 and includes a valve member 58.2 and a valve seat 60.2 which extends about a second passageway 52.2 in the bottom of the reload chamber.

The second one-way valve allows liquid to flow from a source of liquid to be pumped below the apparatus 20.2 into the reload chamber 46.2 and into hollow piston rod 42.2, but prevents liquid from flowing from the reload chamber towards the source below.

There is a transfer chamber 200 adjacent the top 28.2 of the cylinder 26.2 and is sealed with the cylinder apart from the aperture 44.2. The transfer chamber 200 is in the form of a cylinder, in this example, and has a diameter $D_{TC}$. The second portion 220 of the piston rod 42.2 acts as a piston within the transfer chamber 200. There could be a piston member on the end of the piston rod 42.2 within the transfer chamber 200 and the term "piston rod" includes this possibility.

The first one-way valve 41.2 allows liquid to flow into the transfer chamber 200 from the hollow piston rod 42.2 and from the reload chamber 46.2, but prevents a reverse flow into the hollow piston rod and reload chamber.

Since the transfer chamber 200 and the reload chamber 46.2 are above and below the cylinder 26.2 respectively, in this embodiment, the cylinder diameter $D_c$ can be sized such that the piston rod diameter $D_{PR}$ can be equal to or less than the diameters $D_{TR}$ and $D_{RL}$ of the transfer chamber 200 and reload chamber 46.2 respectively, and can also be sized such that the surface area 41.2 of the piston 40.2 is large enough for optimal pumping. The larger the diameter $D_{PR}$ of the piston rod 42.2, the greater the volume of fluid that can be pumped by the apparatus 20.2. The greater the surface area 41.2 of the piston 40.2 the greater the pumping force.

A third one-way valve indicated generally by reference numeral 202 is located at the top 204 of the transfer chamber 200 and includes a valve member 206 and a valve seat 208 which extends about a third passageway 210 in the top of the transfer chamber. There is a discharge chamber 212 above and adjacent to the transfer chamber 200 and is sealed with the transfer chamber apart from the third one-way valve 202. The third one-way valve 202 allows liquid to flow from the transfer chamber 200 into the discharge chamber 212, but prevents a reverse flow of liquid from the discharge chamber into the transfer chamber.

A fourth passageway 214 is located in the bottom 30.2 of the cylinder 26.2 and a fifth passageway 216 is located in the top 28.2 of the cylinder. The fourth and fifth passageways 214 and 216 allow a flow of pressurized liquid into and out of the cylinder spaces 31 and 27 respectively as will be explained below. Typically, the fourth and fifth passageways 214 and 216 respectively would be connected to a source of pressurized liquid via respective conduits and respective valves.

In operation, the apparatus 20.2 is primed by filling the reload chamber 46.2, the hollow piston rod 42.2 and the discharge chamber 200 with fluid, typically water, and the piston is placed in its lowermost position next to bottom 30.2 of cylinder 26.2. The first, second and third one-way valves 41.2, 56.2 and 202 are closed.

During the power stroke, shown in FIG. 6*a*, pressurized fluid is let into the cylinder space 27 through passageway 214. The pressurized fluid acts on the piston 40.2, causing it to rise from the bottom 30.2 towards the top 28.2.

The second portion 220 of the piston rod 42.2 rises upwardly through the aperture 44.2 and thereby creates an increased pressure in the transfer chamber 200 since the volume of space occupied by the second portion in the transfer chamber is increased.

The increased pressure in the transfer chamber 200 causes the valve member 43.2 of the first one-way valve 41.2 to remain firmly seated in its valve seat 45.2, such that liquid is prevented from flowing through passageway 47.2. The increased pressure also causes the valve member 206 of the third one-way valve 202 to rise off its seat 208, such that liquid is allowed to flow from the transfer chamber 200 into the discharge chamber 212.

The volume of liquid flowing from the transfer chamber 200 into the discharge chamber 212 is substantially equal to the increased volume occupied by the second portion 220 of the piston rod 42.2 in the transfer chamber.

Correspondingly, the first portion 218 of the piston rod 42.2 rises upwardly through the aperture 48.2, increasing the volume of space occupied by the reload chamber 46.2 and the hollow piston rod 42.2 combined. Since the first one-way valve 43.2 is closed, as discussed above, the pressure in the reload chamber 46.2 and in the hollow piston rod 42.2 is reduced.

The reduced pressure in the reload chamber 46.2 causes the valve member 58.2 of the second one-way valve 56.2 to rise off its seat 60.2, such that liquid flows from the source below into the reload chamber through passageway 52.2. The volume of liquid flowing from the source into the reload chamber 46.2 is substantially equal to the increase in total volume occupied by the hollow piston rod 42.2 and the reload chamber 46.2 combined, such that the pressure is equalized between the source, the reload chamber and the hollow piston rod.

During the power stroke the piston 40.2 continues to travel until it reaches the top 28.2 of the cylinder 26.2. The increase in the total volume of space occupied by the hollow piston rod 42.2 and the reload chamber 46.2 is equal to the decrease of volume occupied by fluid in the transfer chamber 200. The decrease in volume of fluid in transfer chamber 200 is equal to increase in the volume of space occupied by the second portion 220 of the piston rod in the transfer chamber 200.

Referring now to FIG. 6*b*, during the recovery stroke pressurized fluid is let into the cylinder space 31 through passageway 216. The pressurized fluid acts on the piston 40.2 such that it is deflected downwards from the top 28.2 of cylinder 26.2 towards the bottom 30.2. Simultaneously, pressurized fluid from space 27 is released through passageway 214.

Initially during the recovery stroke, with the first one-way valve 41.2 closed and the third one-way valve 202 open, the pressure in the transfer chamber 200 is decreased since the volume of space occupied by the second portion 220 of the piston rod 42.2 is decreased. This decrease in pressure causes the valve member 206 of the third one-way valve 202 to seat itself on seat 208 which thereby prevents any fluid from the discharge chamber 212 from flowing through passageway 210 into the transfer chamber 200.

Similarly, during the initial period of the recovery stroke with the first one-way valve 41.2 closed and the second one-way valve 56.2 open, the pressure in the reload chamber 46.2 is increased since the total volume of space occupied by the piston rod 42.2 and the reload chamber is decreased while the volume of fluid therein remains at first constant. This increased pressure causes the valve member 58.2 of the second one-way valve 56.2 to seat itself on seat 60.2 which thereby prevents any fluid from the reload chamber 46.2 and the hollow piston rod 42.2 from flowing through passageway 52.2 into the source.

Once the second one-way valve 56.2 closes, the total volume of fluid in the space defined by the reload chamber 46.2, the hollow piston rod 42.2 and the transfer chamber 200 remains constant. During this period of the recovery stroke, with the first one-way valve 41.2, the second one-way valve 56.2 and the third one-way valve 202 closed, the volume of space occupied by the second portion 220 of the piston rod 42.2 in the transfer chamber 200 is reduced as the piston 40.2 travels towards the bottom 30.2 of cylinder 26.2 which causes a reduced pressure in the transfer chamber. A simultaneous increase in pressure occurs in the volume of space contained within the reload chamber 46.2 and the hollow piston rod 42.2.

The decrease in pressure in the transfer chamber 200 and increase in pressure in the hollow piston rod 42.2 and the reload chamber 46.2 causes the valve member 43.2 to rise off its seat 45.2, allowing the fluid to flow from the reload chamber and hollow piston rod into the transfer chamber to equalize the pressure.

The recovery stroke ends with the piston 40.2 next to bottom 30.2 of cylinder 26.2 and with the transfer chamber 200, the hollow piston rod 42.2 and the reload chamber 46.2 filled with liquid. The apparatus 20.2 is then ready for another power stroke. This cycle of a power stroke followed by a recovery stroke is alternately repeated during the operation of the apparatus 20.2.

An advantage of the present embodiment is obtained by the novel use of the third one-way valve 202 which prevents liquid in the discharge chamber 212 from reentering the transfer chamber 200 during the recovery stroke. This improves the efficiency of the pump significantly since energy is not wasted re-pumping the same liquid.

Another advantage is due to the configuration of the reload chamber 46.2, the cylinder 26.2 and the transfer chamber 200. This configuration allows the piston rod diameter $D_{PR}$ to be equal to or less than the diameters $D_{RL}$ and $D_{TC}$ of the reload chamber and transfer chamber respectively. The greater the piston rod diameter $D_{PR}$, the greater the volume of fluid that can be pumped by the apparatus 20.2. Furthermore, since the diameter $D_C$ of the cylinder 26.2 is not bound by either the reload chamber 46.2 or the transfer chamber 200, the surface area 41.2 of the piston 40.2 can be made as large as necessary for an optimal pumping force. The greater the surface area 41.2 of the piston 40.2, the greater the force of the piston rod 42.2 acting on the water in the transfer chamber 200 for a given pressurized fluid on the piston through passageway 214.

What is claimed is:

1. A method for pumping liquid, comprising:

introducing a hydraulic fluid into a piston-type pumping apparatus through a first passageway in a vertically oriented cylinder, whereby a piston housed within the cylinder is raised and a hollow piston rod attached to the piston rises upwardly through a first aperture in a transfer chamber, the transfer chamber sealingly attached to the top of the cylinder in a position radially spaced apart from the first aperture such that the top portion of the hollow piston rod does not contact an interior side surface of the transfer chamber as it rises upwardly through the first aperture, wherein a first one-way valve in the hollow piston rod is closed, whereby liquid is prevented from flowing from the transfer chamber into the hollow piston rod and the hollow piston rod attached to the piston rises upwardly through a second aperture in a reload chamber, wherein an inside diameter of the cylinder is greater than an inside diameter of the reload chamber, wherein a second one-way valve is opened to allow liquid flow into the reload chamber from outside the piston-type pumping apparatus, wherein raising the hollow piston rod upwardly into the transfer chamber displaces liquid in the transfer chamber through a third one-way valve into a discharge chamber, wherein an inside diameter of the piston rod is less than or equal to the inside diameter of the reload chamber and an inside diameter of the transfer chamber, respectively, wherein increasing an inside diameter of the piston rod increases a volume of liquid pumped by the piston-type pumping apparatus, and wherein increasing a piston surface area increases a force on the piston rod acting on liquid in the transfer chamber; and introducing hydraulic fluid through a second passageway into the cylinder, whereby the piston is lowered and hydraulic fluid exits the cylinder through the first passageway, wherein the third one-way valve is closed, thereby preventing liquid flow from the discharge chamber into the transfer chamber, wherein the second one-way valve is closed thereby preventing liquid flow from the reload chamber and the hollow piston rod from exiting the piston-type pumping apparatus, and wherein the first one-way valve is opened to allow liquid to flow from the reload chamber and the hollow piston rod into the transfer chamber.

2. The method of claim 1 further comprising priming the reload chamber.

3. The method of claim 2, wherein priming the reload chamber comprises filling the reload chamber, the hollow piston rod and the discharge chamber with liquid to be pumped;

placing the piston in its lowermost position adjacent to the bottom of the cylinder; and closing the first one-way valve, the second one-way valve and the third one-way valve.

* * * * *

UNITED STATES PATENT AND TRADEMARK OFFICE

CERTIFICATE OF CORRECTION

PATENT NO. : 8,535,017 B2
APPLICATION NO. : 13/169243
DATED : September 17, 2013
INVENTOR(S) : McNichol et al.

It is certified that error appears in the above-identified patent and that said Letters Patent is hereby corrected as shown below:

In the Specification

In column 6 at line 35, Change "$F=F_d-F_uP_1A_1+W-P_2(A_1-A_2)-P_4A_2-R$" to --$F=F_d-F_u=P_1A_1+W-P_2(A_1-A_2)\ P_4A_2-R$--.

In column 10 at line 20, Change "$(P_s)$" to --$(P_c)$--.

Signed and Sealed this
Twenty-fourth Day of June, 2014

Michelle K. Lee

Michelle K. Lee
*Deputy Director of the United States Patent and Trademark Office*